US009541866B2

(12) United States Patent
Onishi

(10) Patent No.: US 9,541,866 B2
(45) Date of Patent: Jan. 10, 2017

(54) FIXING DEVICE THAT REDUCES FRICTION AGAINST SHEET AND IMAGE FORMING APPARATUS INCLUDING THE SAME

(71) Applicant: Kyocera Document Solutions Inc., Osaka (JP)

(72) Inventor: Yuzo Onishi, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 14/971,739

(22) Filed: Dec. 16, 2015

(65) Prior Publication Data

US 2016/0170341 A1 Jun. 16, 2016

(30) Foreign Application Priority Data

Dec. 16, 2014 (JP) ..... 2014-254116

(51) Int. Cl.
*G03G 15/20* (2006.01)

(52) U.S. Cl.
CPC ..... *G03G 15/2028* (2013.01); *G03G 15/2064* (2013.01)

(58) Field of Classification Search
CPC ..... G03G 15/2028; G03G 15/2085
USPC ..... 399/322, 323
See application file for complete search history.

(56) References Cited

U.S. PATENT DOCUMENTS 9,081,337 B2 * 7/2015 Nakano ..... G03G 15/2028

FOREIGN PATENT DOCUMENTS

JP 2003-345154 A 12/2003

* cited by examiner

*Primary Examiner* — Hoang Ngo
(74) *Attorney, Agent, or Firm* — James Judge

(57) ABSTRACT

A fixing device includes a heating member, a pressure member, and a conveyance guide. The heating member internally includes a heating element. The pressure member includes an elastic layer located to be pressed against the heating member to ensure a fixing nip area between the heating member and the pressure member. The conveyance guide is located upstream with respect to the fixing nip area in a conveying path of a sheet on which the toner image is formed, and assists the sheet to run. The conveyance guide includes a first guiding portion that guides a head of the sheet to a distal end position close to the heating member and a second guiding portion that guides a tail of the sheet from the distal end position to an intermediate position between the heating member and the pressure member.

12 Claims, 11 Drawing Sheets

FIXING DEVICE THAT REDUCES FRICTION AGAINST SHEET AND IMAGE FORMING APPARATUS INCLUDING THE SAME

INCORPORATION BY REFERENCE

This application is based upon, and claims the benefit of priority from, corresponding Japanese Patent Application No. 2014-254116 filed in the Japan Patent Office on Dec. 16, 2014, the entire contents of which are incorporated herein by reference.

BACKGROUND

Unless otherwise indicated herein, the description in this section is not prior art to the claims in this application and is not admitted to be prior art by inclusion in this section.

A fixing device, which is internally included in an electrophotographic or electrostatic recording type image forming apparatus, causes a sheet on which a toner image is formed by a previous process to pass and be sandwiched between two rollers (hereinafter referred to as a fixing nip area), a heating roller and a pressure roller. Thus, the fixing device applies pressure to and heats this sheet to fix the toner image. When a head of the sheet contacts a pressure roller before the head of the sheet reaches a fixing nip area, the sheet is easily caught in the pressure roller by an elastic layer of the pressure roller in the fixing device described above. This may generate a wrinkle on the sheet.

It is known that guiding the head of the sheet conveyed by a conveyance guide to a position close to the heating roller at an upstream side of the fixing nip area can prevent such wrinkle generation. A fixing device that prevents the wrinkle generation when curling a comparatively light and inelastic sheet has been disclosed. Additionally, the fixing device reduces a generation of a toner image disturbance due to a collision between a distal end of the sheet and a guiding portion when using a thick sheet.

SUMMARY

A fixing device according to one aspect of the disclosure applies pressure and heats a sheet on which a toner image is formed to weld toner onto the sheet so as to fix the toner image. The fixing device includes a heating member, a pressure member, and a conveyance guide. The heating member internally includes a heating element. The pressure member includes an elastic layer located to be pressed against the heating member to ensure a fixing nip area between the heating member and the pressure member. The conveyance guide is located upstream with respect to the fixing nip area in a conveying path of a sheet on which the toner image is formed, and assists the sheet to run. The conveyance guide includes a first guiding portion that guides a head of the sheet to a distal end position close to the heating member and a second guiding portion that guides a tail of the sheet from the distal end position to an intermediate position between the heating member and the pressure member.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
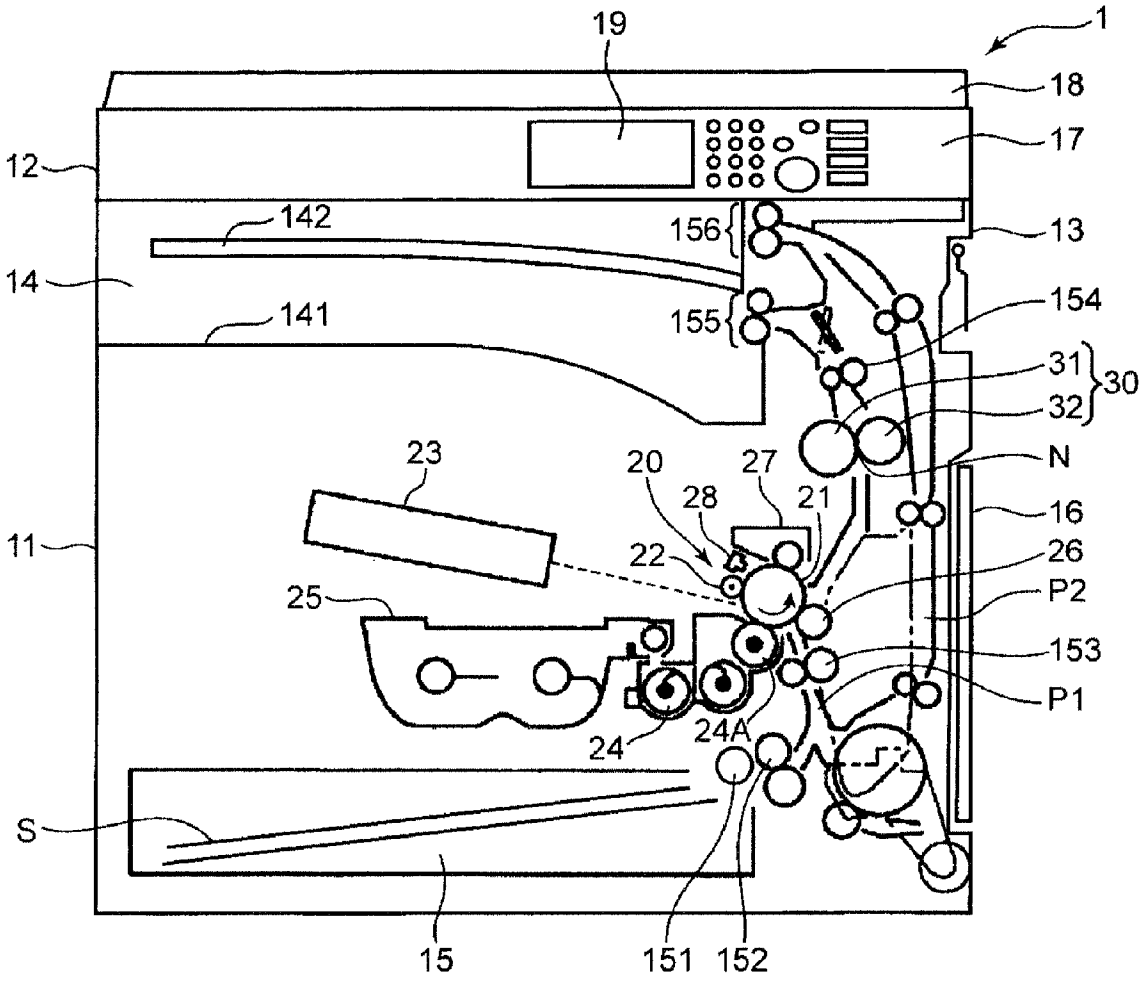
FIG. 1 illustrates an outline of an image forming apparatus according to an embodiment.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

Embodiment

Outline

An image forming apparatus of an embodiment causes a conveyance guide included in a fixing device to guide a head of a sheet to a position close to a heating roller. This prevents a generation of a wrinkle on the sheet due to contact on a pressure roller before the head of the sheet reaches a fixing nip area, and the conveyance guide guides a tail of the sheet to a heating roller direction to reduce a generation of an image failure that is caused by the end of the sheet springing to a pressure roller side.

Overall Configuration

FIG. 1 illustrates an outline of an image forming apparatus 1 according to the embodiment. The image forming apparatus 1 is a monochrome printer with a copy function, and includes a main body housing portion 11, a scanner housing portion 12, a concatenation housing portion 13 and an in-barrel paper discharge unit 14. The main body housing portion 11 is located below the image forming apparatus 1, and includes a sheet feed cassette 15, a bypass tray 16, an image forming unit 20, a pickup roller 151, a feed roller pair 152, and a registration roller pair 153.

The sheet feed cassette 15 houses a document sheet S. The pickup roller 151 feeds the document sheet S in the sheet feed cassette 15 from a top of the document sheets S one by one. The feed roller pair 152 sends out the document sheet S to an upstream end of a main conveyance path P1. The registration roller pair 153 sends out the document sheet S to the image forming unit 20. The bypass tray 16 supplies a manual document sheet in a manual paper feeding. The manual document sheet placed on the bypass tray 16 is sent out to the upstream end of the main conveyance path P1. Here, the main conveyance path P1 is a conveyance path that the document sheet S and the manual document sheet pass from the feed roller pair 152 to the in-barrel paper discharge unit 14. An inverting conveyance path P2 is a conveyance path used for inverting the sheet in a duplex printing.

The image forming unit 20 includes a photoreceptor drum 21, a charging apparatus 22, an exposure apparatus 23, a developing device 24, a toner container 25, a transfer roller 26, a cleaning apparatus 27, and a static eliminator 28 to form a toner image on the document sheet S or the manual document sheet. The photoreceptor drum 21 rotates around a rotation shaft, and includes a circumference surface on which an electrostatic latent image and the toner image are formed. The charging apparatus 22 uniformly charges the circumference surface of the photoreceptor drum 21. The exposure apparatus 23 irradiates the circumference surface of the photoreceptor drum 21 with a laser beam to form the electrostatic latent image. The developing device 24 includes a development roller 24A, which supplies a toner to the circumference surface of the photoreceptor drum 21, to develop the electrostatic latent image formed on the photoreceptor drum 21. The toner container 25 stores a toner replenished the developing device 24. The transfer roller 26 forms a transfer nip area between the photoreceptor drum 21 to transfer the toner image formed on the photoreceptor drum 21 on the document sheet S or the manual document sheet. The cleaning apparatus 27 cleans the circumference surface of the photoreceptor drum 21 after transferring the toner image. The static eliminator 28 irradiates the circumference surface of the photoreceptor drum 21 with a charge removing light after transferring the toner image to diselectrify.

The scanner housing portion 12 is located at an upper side of the image forming apparatus 1, and houses a scanner unit 17. The scanner housing portion 12 includes a contact glass (not illustrated) engaged in a top surface of the scanner unit 17, a pressing cover 18, and an operation panel 19. The scanner unit 17 includes an imaging device, a light source, a mirror, and a lens (each of components is not illustrated) and similar component. The scanner unit 17 irradiates an image on an object to be read (hereinafter referred to as a "document") placed on the contact glass with a light of this light source, and then the mirror and the lens guides its reflected light to the imaging device to read optically a document and generate image data.

The pressing cover 18 reduces a float of the document placed on the contact glass and, covers the document and the contact glass to prevent an extra external light from entering into the scanner unit 17. The operation panel 19 is exposed ahead of the scanner housing portion 12, and includes a LCD touch panel and a numeric keypad to accept various kinds of operations to the image forming apparatus 1 from a user. The concatenation housing portion 13 is located between the main body housing portion 11 and the scanner housing portion 12, houses a fixing device 30, and includes a first sheet discharge port 155 and a second sheet discharge port 156.

The fixing device 30 includes a fixing roller 31, a pressure roller 32, and a sheet conveyance roller 154. The fixing device 30 causes the sheet on which the toner image is formed by the image forming unit 20 to pass between two rollers (hereinafter referred to as a fixing nip area N), the fixing roller 31 and the pressure roller 32, while sandwiching in a fixing nip area N to apply pressure and heat. Then, the fixing device 30 welds the toner onto the sheet to fix the toner image. The fixing roller 31 is a heating member that includes a heating element such as a halogen heater in a metallic cylinder.

The pressure roller 32 is a pressure member that includes an elastic layer located to be pressed against the fixing roller 31 and ensure the fixing nip area N between the fixing roller 31 and the elastic layer. An elastic insulation layer such as a silicon rubber and a release layer such as a fluororesin, and similar layer are laminated on an outer periphery of a core shaft of, for example, a cylinder-shaped steel or an aluminum pipe. The embodiment applies rotary drive power to the fixing roller 31, and rotation of the fixing roller 31 cause the pressure roller 32 to perform passive rotation. The fixing device 30 additionally includes a conveyance guide 40 (not illustrated in FIG. 1) that is located at an upstream with respect to the fixing nip area N. The conveyance guide 40 assists a sheet to run in a conveying path of the sheet on which the toner image is formed by the image forming unit 20. Detail of the conveyance guide 40 will be described later.

The in-barrel paper discharge unit 14 is an in-barrel space where the sheet is discharged after image formation, and is surrounded with a top surface of the main body housing portion 11, an inferior surface of the scanner housing portion 12, and a left surface of the concatenation housing portion 13. The in-barrel paper discharge unit 14 includes an in-barrel sheet discharge tray 141 and a sub sheet discharge tray 142. An image-formed sheet discharged from the first sheet discharge port 155 is accumulated on the in-barrel sheet discharge tray 141. An image-formed sheet discharged from the second sheet discharge port 156 is accumulated on the sub sheet discharge tray 142.

Detail of Conveyance Guide

Figure 2:
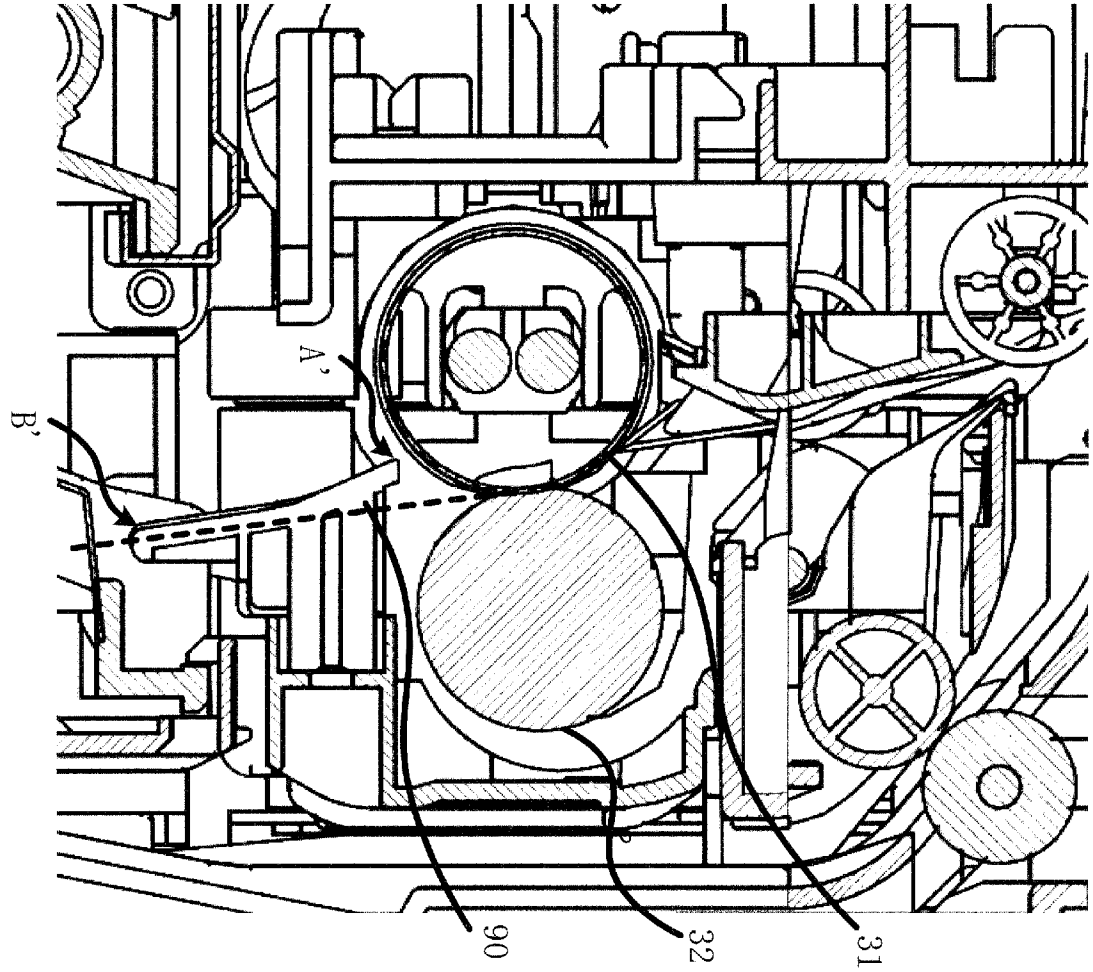
FIG. 2 illustrates an enlarged periphery of a fixing device as a comparison target that a countermeasure of the embodiment is not performed.
Figure 3:
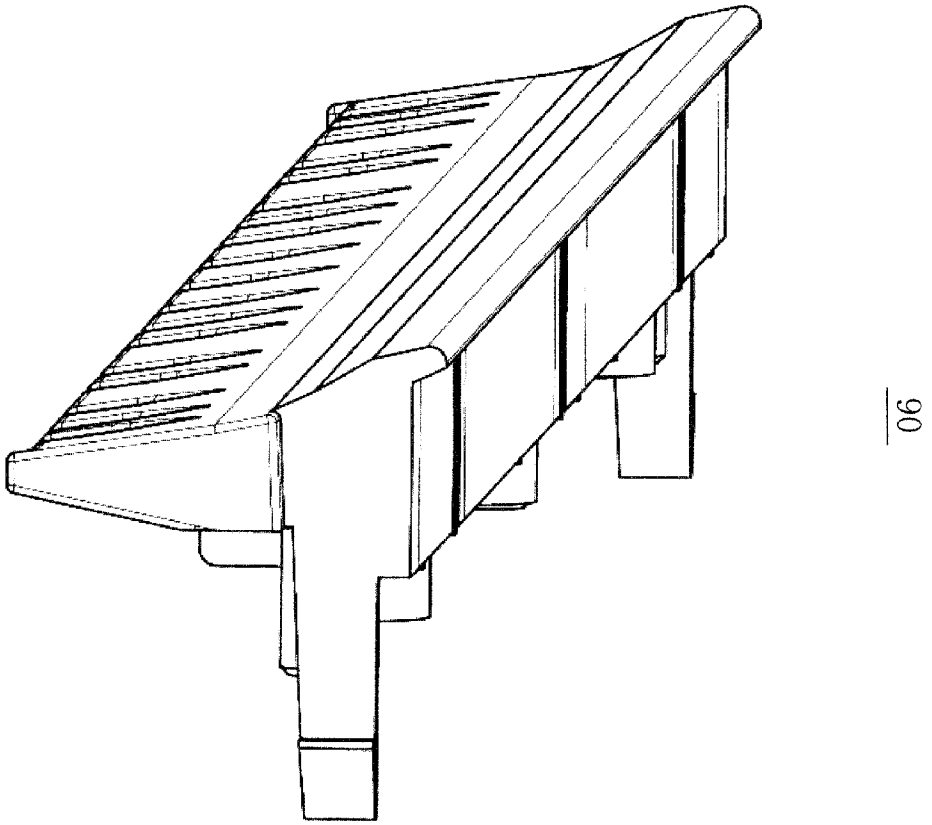
FIG. 3 obliquely illustrates an external appearance of a conveyance guide as the comparison target.
Figure 4:
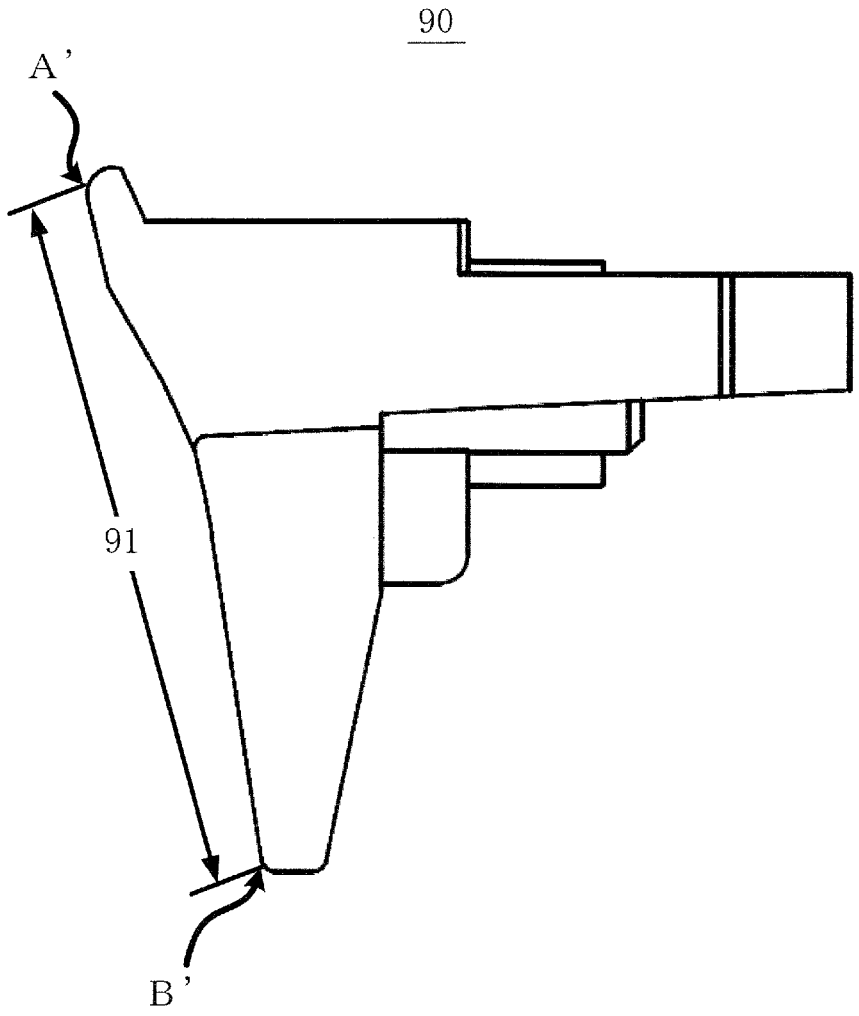
FIG. 4 illustrates the conveyance guide as the comparison target from a shaft center direction of a rotation shaft of a fixing roller.

FIG. 2 illustrates an enlarged periphery of a fixing device as a comparison target that a countermeasure of the embodiment is not performed. As illustrated in FIG. 2, the fixing device as the comparison target includes the fixing roller 31, the pressure roller 32, and a conveyance guide 90 as the comparison target. FIG. 3 obliquely illustrates an external appearance of the conveyance guide 90 as the comparison target. FIG. 4 illustrates the conveyance guide 90 as the comparison target from a shaft center direction of a rotation shaft of a fixing roller.

As illustrated in FIGS. 2 to 4, the conveyance guide 90 includes a guiding portion 91. The guiding portion 91 is a portion that guides the head of the sheet to a distal end position A', which is close to the fixing roller 31, and is an inclined surface that continues from an upstream side B' of the sheet conveying path upstream with respect to the distal end position A' to the distal end position A', specifically.

The fixing device as the comparison target causes a problem that the image failure may be generated due to the end of the sheet springing to a side of the pressure roller 32 after the end of the sheet passes through the distal end position A' of the conveyance guide 90.

Figure 5:
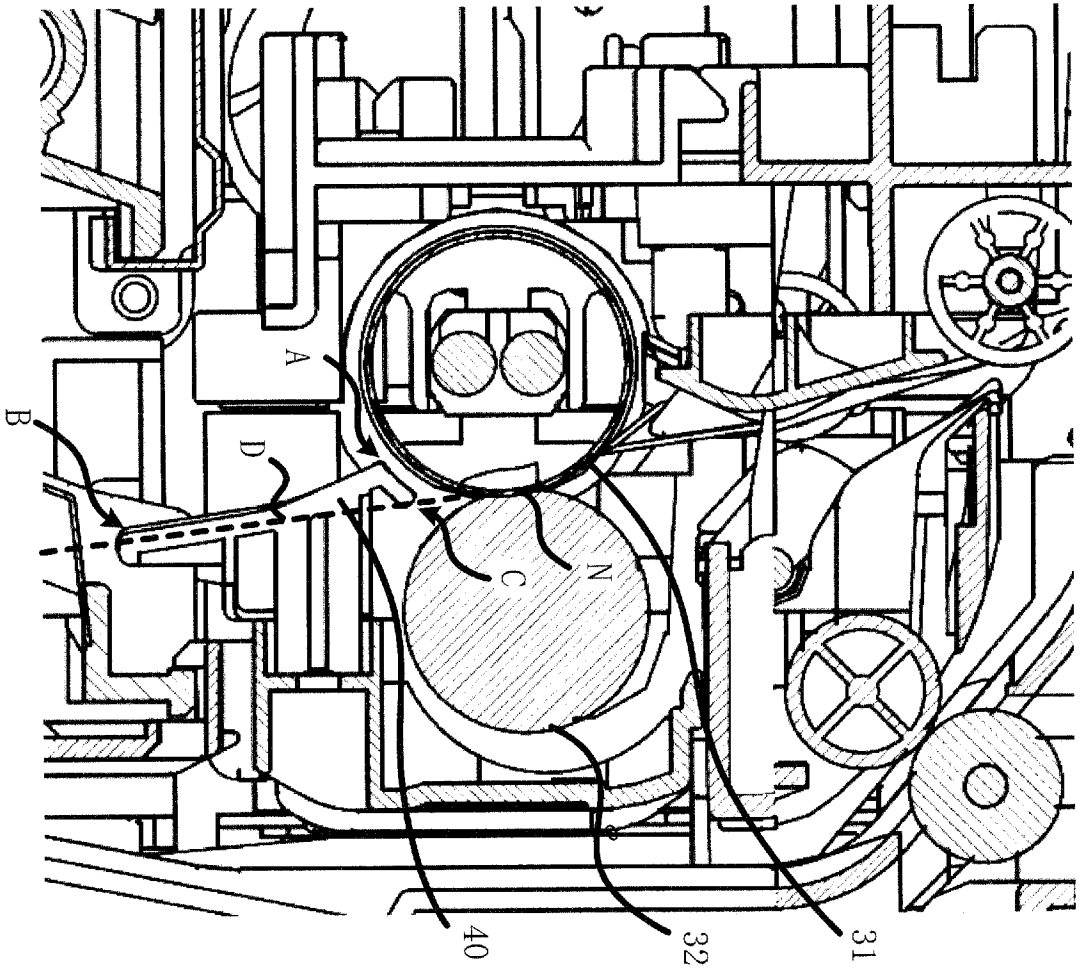
FIG. 5 illustrates an enlarged periphery of the fixing device of the embodiment.
Figure 6:
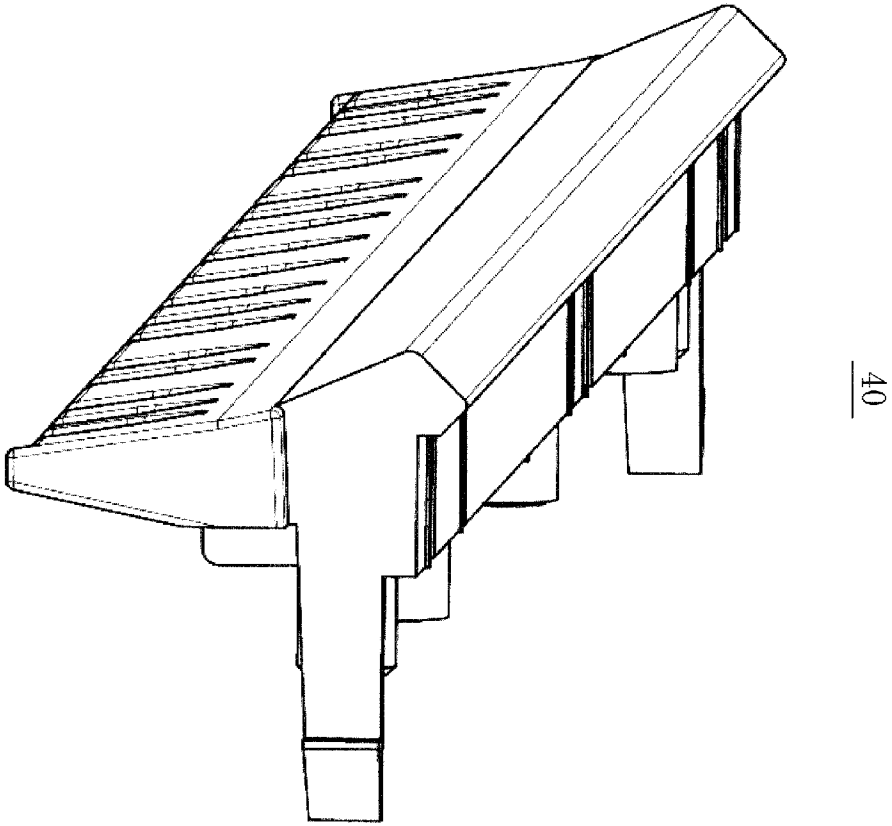
FIG. 6 obliquely illustrates an external appearance of the conveyance guide of the embodiment.
Figure 7:
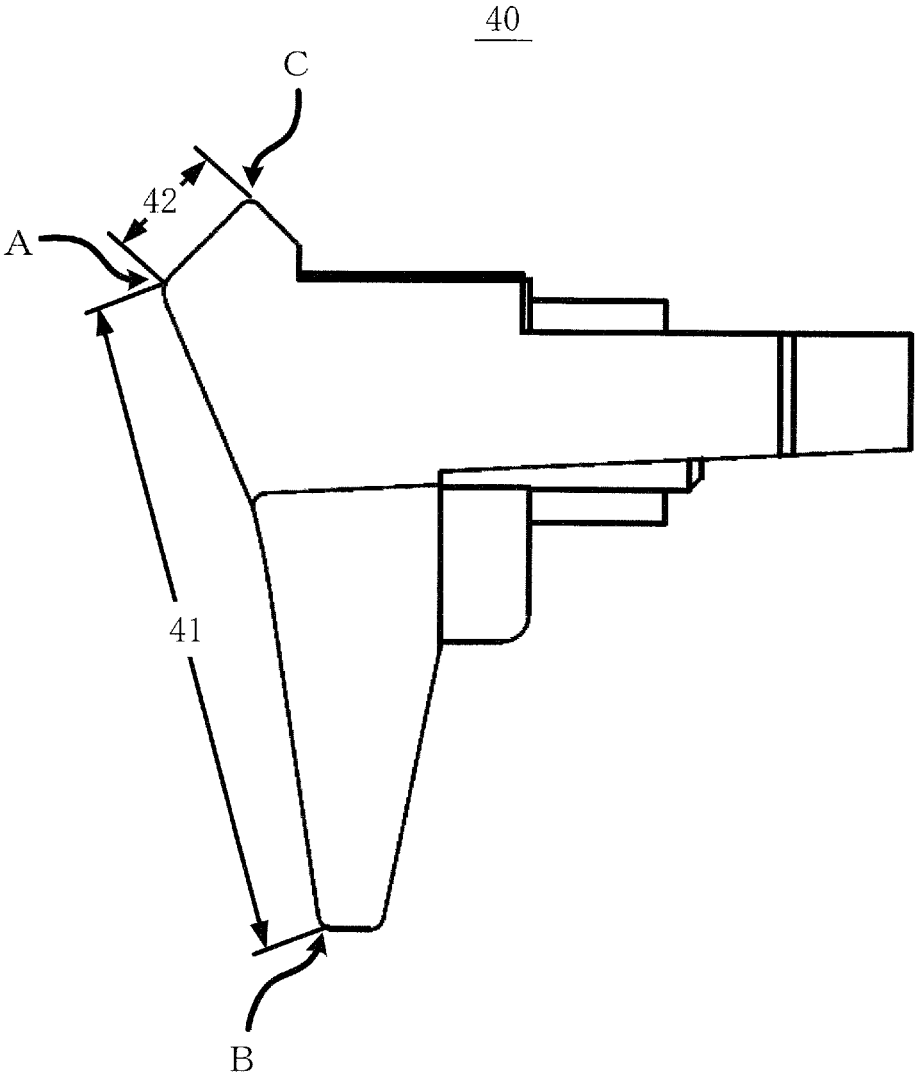
FIG. 7 illustrates the conveyance guide of the embodiment from the shaft center direction of the rotation shaft of the fixing roller.

FIG. 5 illustrates an enlarged periphery of the fixing device 30 of the embodiment. As illustrated in FIG. 5, the fixing device 30 of the embodiment includes the fixing roller 31, the pressure roller 32, and the conveyance guide 40. FIG. 6 obliquely illustrates an external appearance of the conveyance guide 40 of the embodiment. FIG. 7 illustrates the conveyance guide 40 of the embodiment from the shaft center direction of the rotation shaft of the fixing roller.

As illustrated in FIGS. 5 to 7, the conveyance guide 40 includes a first guiding portion 41 and a second guiding portion 42. The first guiding portion 41 is a portion that guides the head of the sheet to a distal end position A, which is close to the fixing roller 31, and is an inclined surface that continues from an upstream side B of the sheet conveying path upstream with respect to the distal end position A to the distal end position A as well as the guiding portion 91 as the comparison target, specifically.

Here, the distal end position A is a position that is close to the fixing roller 31 compared with a tangent line D (a dashed line illustrated in FIG. 5) of the fixing roller 31 at a center of the fixing nip area N, and is the most separated from the tangent line D. The upstream side B is close to the tangent line D compared with the distal end position A. Here, the distal end position A connects the first guiding portion 41 to the second guiding portion 42.

The second guiding portion 42 is a portion that guides the tail of the sheet from the distal end position A to an intermediate position C that is not close to at least the fixing roller 31 or the pressure roller 32. Specifically, the second guiding portion 42 is an inclined surface that continues from the distal end position A to the intermediate position C. This inclined surface is linear here when viewing from a shaft center direction of a rotation shaft of the fixing roller 31; however, the inclined surface may be convex and curved in a separated direction from the fixing roller 31. The intermediate position C is on the tangent line D, and at a downstream of the sheet conveying path with respect to the distal end position A. Here, the intermediate position C is specified by, for example, a sheet thickness, a sheet conveyance speed, and a sheet conveyance direction (a horizontal or vertical direction), however, the intermediate position C may be a position that can regulate the tail of the sheet springing to a side of the pressure roller 32 when the tail of the sheet is separated from the distal end position A. In other words, the second guiding portion 42 guides the tail of the sheet to supply the tail of the sheet to the fixing nip area N while regulating the tail of the sheet springing to a side of the pressure roller side.

It is preferred that a distance from the distal end position A to an outer peripheral surface of the fixing roller 31 be identical to a distance from the intermediate position C to the outer peripheral surface of the fixing roller 31. This can cause the second guiding portion 42 to be close to the fixing roller 31 overall to prevent the tail of the sheet from springing to the side of the pressure roller 32 with further certainly.

It is preferred that the second guiding portion 42 have a surface whose kinetic friction coefficient is higher than a kinetic friction coefficient of the first guiding portion 41. Thus, the second guiding portion 42, whose surface has the high kinetic friction coefficient, guides the tail of the sheet more calmly.

It is additionally preferred that a joint portion of the first guiding portion 41 and the second guiding portion 42 be mirror-like finished. This can reduce friction when the joint portion described above grazes against the sheet to be hard for the sheet to be caught in the joint portion and to be damaged. This can additionally reduce abrasion of the joint portion described above due to grazing against the sheet to improve durability of the conveyance guide 40.

As described above, according to the fixing device of the embodiment, the second guiding portion 42 gradually guides in a direction of the pressure roller 32 after the tail of the sheet passes through the first guiding portion 41. This can reduce the generation of the image failure that is caused by the tail of the sheet springing to the side of the pressure roller 32.

Modification 1

Figure 8:
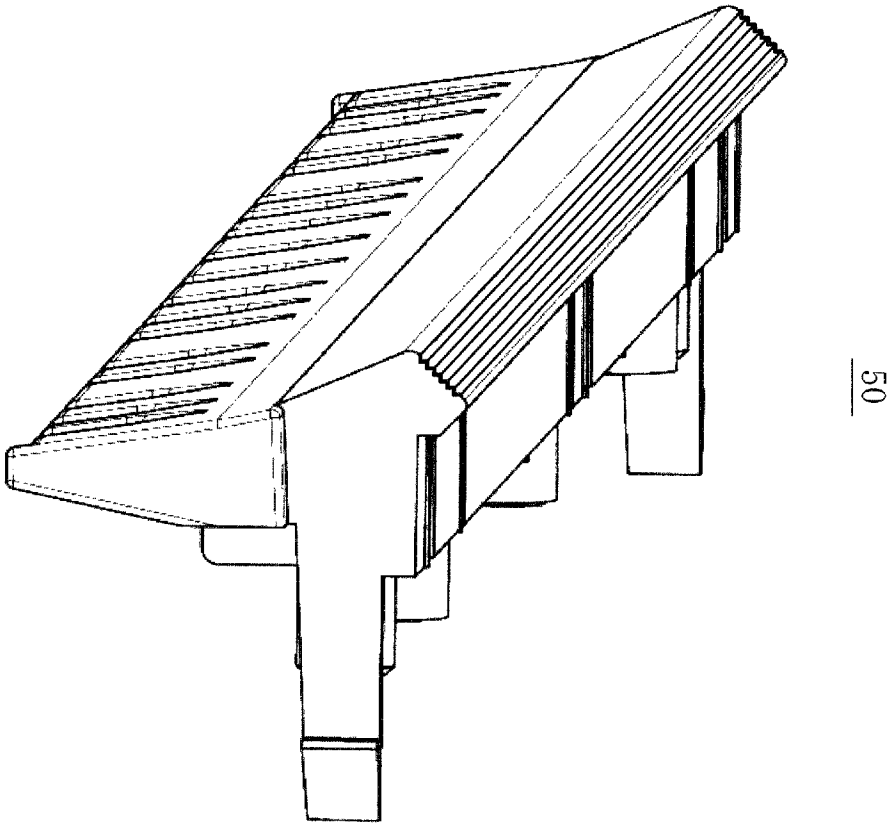
FIG. 8 obliquely illustrates an external appearance of a conveyance guide of Modification 1.
Figure 9:
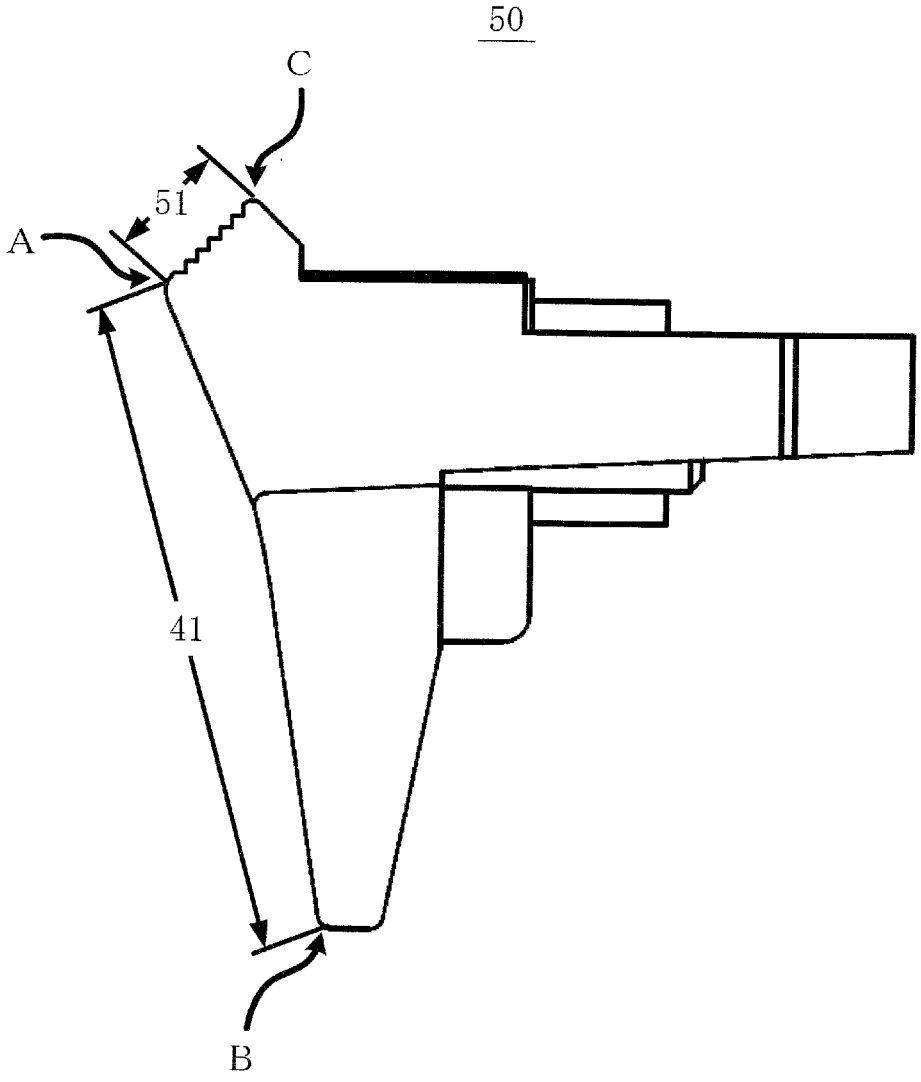
FIG. 9 illustrates the conveyance guide of Modification 1 from the shaft center direction of the rotation shaft of the fixing roller.

FIG. 8 obliquely illustrates an external appearance of a conveyance guide 50 of Modification 1. FIG. 9 illustrates the conveyance guide 50 of Modification 1 from the shaft center direction of the rotation shaft of the fixing roller 31.

As illustrated in FIGS. 8 and 9, the conveyance guide 50 includes the first guiding portion 41 and a second guiding portion 51. The second guiding portion 51 is a stairs that continues from the distal end position A to the intermediate position C. The distal end position A and the intermediate position C are respectively identical to the distal end position A and the intermediate position C, which have been described in the embodiment. It is preferred that the stairs of this case have one step whose size range be equal to or more than 0 mm and equal to or less than 1 mm. The steps that have a size within this range can decrease an amount (a distance) of springing the tail of the sheet to prevent the image failure.

As described above, according to the fixing device of Modification 1, the stairs smoothly guides the tail of the sheet. This stairs has an identical step size; however, for example, the stairs may have smaller steps as approaching the intermediate position C, or larger and smaller steps. The stairs is located on a linear surface when viewing from the shaft center direction of the rotation shaft of the fixing roller 31, however, the stairs may be locate on a convex and curved surface in the separated direction from the fixing roller 31.

Modification 2

Figure 10:
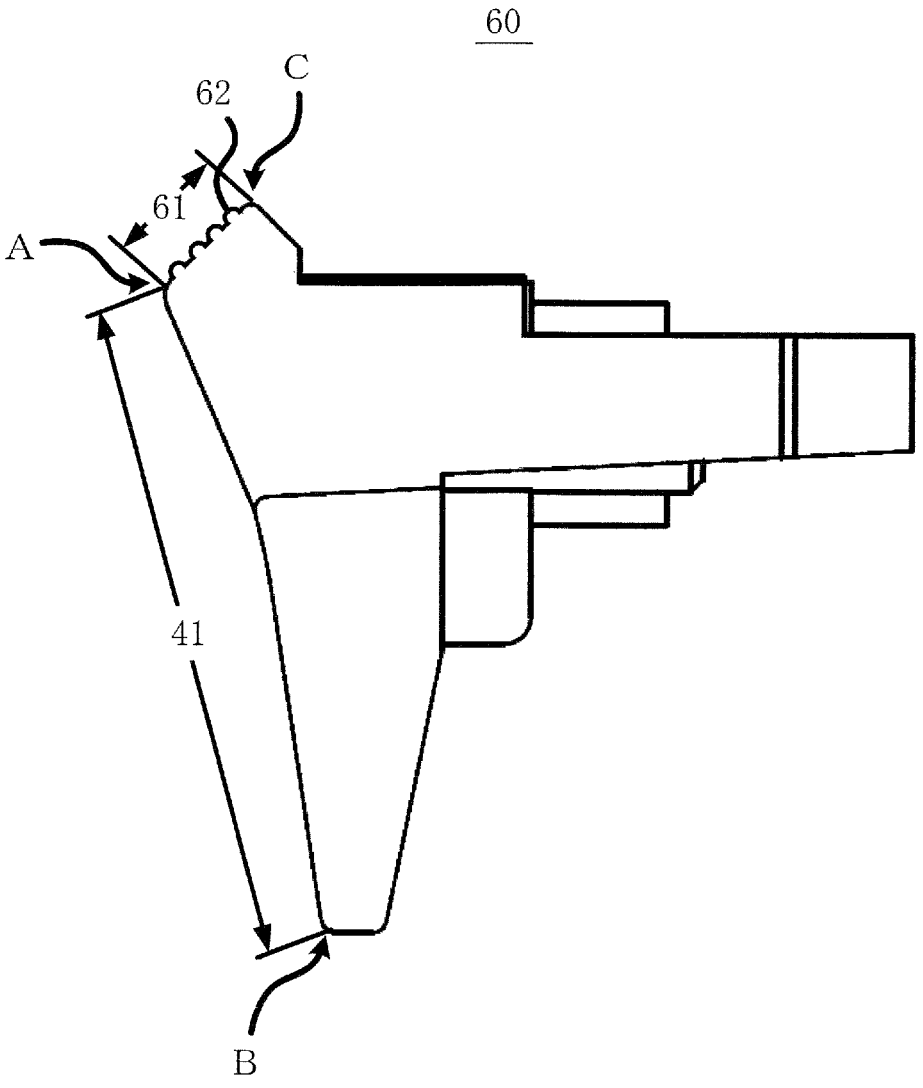
FIG. 10 illustrates the conveyance guide of Modification 2 from the shaft center direction of the rotation shaft of the fixing roller.

FIG. 10 illustrates a conveyance guide 60 of Modification 2 from the shaft center direction of the rotation shaft of the fixing roller. As illustrated in FIG. 10, the conveyance guide 60 includes the first guiding portion 41 and a second guiding portion 61. The distal end position A and the intermediate position C are respectively identical to the distal end position A and the intermediate position C, which have been described in the embodiment.

The second guiding portion 61 includes a long protrusion 62 in a rotation shaft direction of the fixing roller 31. It is preferred that a size range of the protrusion 62 be equal to or more than 0 mm and equal to or less than 1 mm in this case. The protrusion that has this size range can decrease the amount (the distance) of springing the tail of the sheet to prevent the image failure. Here, a shape of the protrusion 62 is half circular shape; however, the shape may be another shape such as triangular-shape or trapezoidal-shape. As described above, according to the fixing device of Modification 2, the protrusion 62 smoothly guides the tail of the sheet.

This protrusion 62 has an identical size; however, for example, the protrusion may have smaller protrusions as approaching the intermediate position C, or larger and smaller protrusions. The protrusion is located on a linear surface when viewing from the shaft center direction of the rotation shaft of the fixing roller 31, however, the protrusion may be locate on a convex and curved surface in the separated direction from the fixing roller 31.

Modification 3

Figure 11:
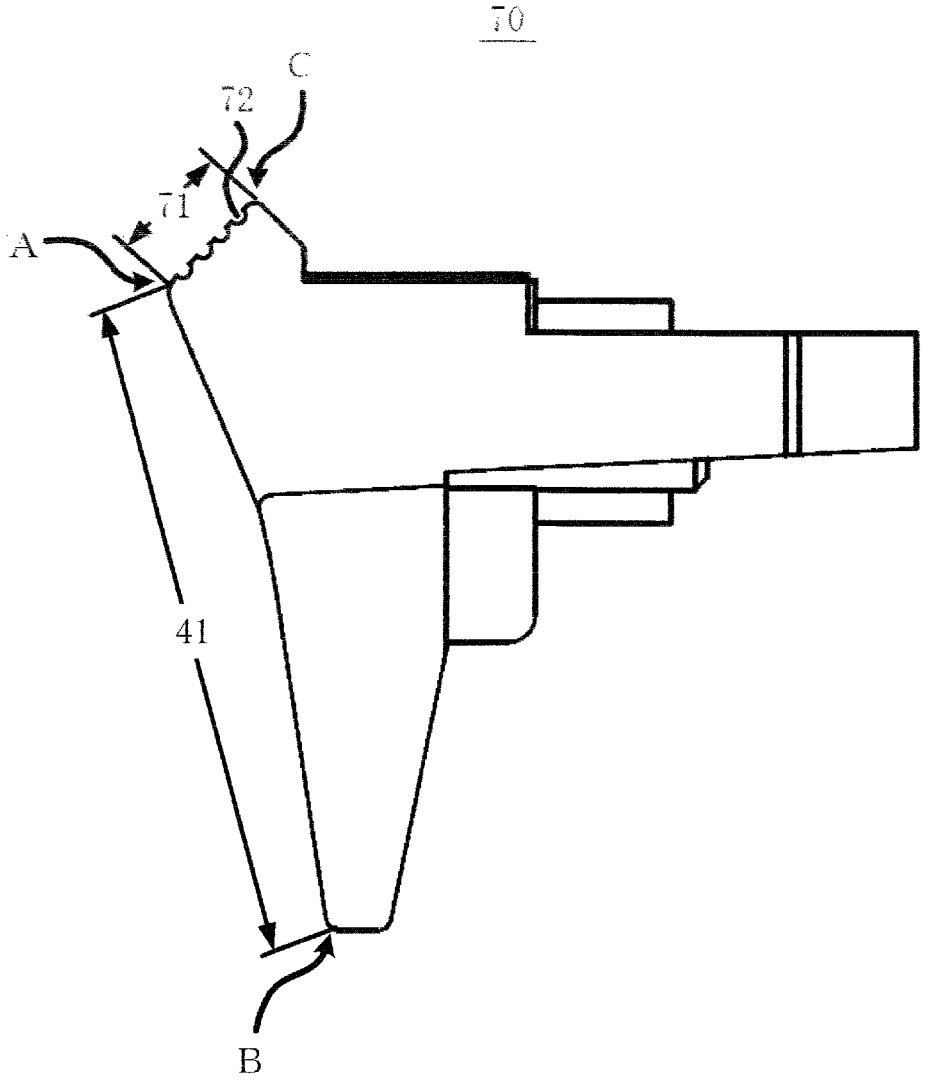
FIG. 11 illustrates the conveyance guide of Modification 3 from the shaft center direction of the rotation shaft of the fixing roller.

FIG. 11 illustrates a conveyance guide 70 of Modification 3 from the shaft center direction of the rotation shaft of the fixing roller. As illustrated in FIG. 11, the conveyance guide 70 includes the first guiding portion 41 and a second guiding portion 71. The distal end position A and the intermediate position C are respectively identical to the distal end position A and the intermediate position C, which have been described in the embodiment.

The second guiding portion 71 includes a long groove 72 in the rotation shaft direction of the fixing roller 31. It is preferred that a depth range of the groove 72 be equal to or more than 0 mm and equal to or less than 1 mm in this case. The groove that has this depth range can decrease the amount (the distance) of springing the tail of the sheet to prevent the image failure. Here, a shape of the groove 72 is half circular shape; however, the shape may be another shape such as triangular-shape or trapezoidal-shape. As described above, according to the fixing device of Modification 3, the groove 72 calmly guides the tail of the sheet.

The disclosure is applicable to an image forming apparatus. The disclosure can reduce a generation of a wrinkle on a sheet and an image failure, and causes a significantly high-industrial use value.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A fixing device for applying pressure to and heating a sheet on which a toner image is formed to weld toner onto the sheet so as to fix the toner image, the fixing device comprising:

a heating member internally including a heating element;

a pressure member including an elastic layer located to be pressed against the heating member to ensure a fixing nip area between the heating member and the pressure member; and a conveyance guide located upstream with respect to the fixing nip area in a conveying path of a sheet on which the toner image is formed, the conveyance guide assisting the sheet to run; wherein the conveyance guide includes a first guiding portion that guides a head of the sheet to a distal end position close to the heating member, and a second guiding portion that guides a tail of the sheet from the distal end position to an intermediate position between the heating member and the pressure member, the second guiding portion having a surface whose kinetic friction coefficient is higher than a kinetic friction coefficient of the first guiding portion.

2. The fixing device according to claim 1, wherein the second guiding portion has a distance from the distal end position to the heating member approximately identical to a distance from the intermediate position to the heating member.

3. The fixing device according to claim 1, wherein:

the first guiding portion and the second guiding portion are joined at the distal end position; and the joint portion of the first guiding portion and the second guiding portion is mirror-like finished.

4. An image forming apparatus comprising the fixing device according to claim 1.

5. A fixing device for applying pressure to and heating a sheet on which a toner image is formed to weld toner onto the sheet so as to fix the toner image, the fixing device comprising:

a heating member internally including a heating element;

a pressure member including an elastic layer located to be pressed against the heating member to ensure a fixing nip area between the heating member and the pressure member; and a conveyance guide located upstream with respect to the fixing nip area in a conveying path of a sheet on which the toner image is formed, the conveyance guide assisting the sheet to run; wherein the conveyance guide includes a first guiding portion that guides a head of the sheet to a distal end position close to the heating member, the first guiding portion including an inclined surface that continues from an upstream side with respect to the distal end position of the conveying path of the sheet, to the distal end position, and a second guiding portion that guides a tail of the sheet from the distal end position to an intermediate position between the heating member and the pressure member, the second guiding portion including a stairs that continues from the distal end position to the intermediate position.

6. The fixing device according to claim 5, wherein the second guiding portion has a distance from the distal end position to the heating member approximately identical to a distance from the intermediate position to the heating member.

7. The fixing device according to claim 5, wherein:

the first guiding portion and the second guiding portion are joined at the distal end position; and the joint portion of the first guiding portion and the second guiding portion is mirror-like finished.

8. An image forming apparatus comprising the fixing device according to claim 5.

9. A fixing device for applying pressure to and heating a sheet on which a toner image is formed to weld toner onto the sheet so as to fix the toner image, the fixing device comprising:

a heating member internally including a heating element;

a pressure member including an elastic layer located to be pressed against the heating member to ensure a fixing nip area between the heating member and the pressure member; and a conveyance guide located upstream with respect to the fixing nip area in a conveying path of a sheet on which the toner image is formed, the conveyance guide assisting the sheet to run; wherein the conveyance guide includes a first guiding portion that guides a head of the sheet to a distal end position close to the heating member, the first guiding portion including an inclined surface that continues from an upstream side with respect to the distal end position of the conveying path of the sheet, to the distal end position, and a second guiding portion that guides a tail of the sheet from the distal end position to an intermediate position between the heating member and the pressure member, the second guiding portion including a long protrusion or a long groove in a rotation shaft direction of the heating member.

10. The fixing device according to claim 9, wherein the second guiding portion has a distance from the distal end position to the heating member approximately identical to a distance from the intermediate position to the heating member.

11. The fixing device according to claim 9, wherein:

the first guiding portion and the second guiding portion are joined at the distal end position; and the joint portion of the first guiding portion and the second guiding portion is mirror-like finished.

12. An image forming apparatus comprising the fixing device according to claim 9.

* * * * *